US006506531B1

(12) United States Patent
Hakata et al.

(10) Patent No.: US 6,506,531 B1
(45) Date of Patent: Jan. 14, 2003

(54) MAGNETIC CARRIER

(75) Inventors: Toshiyuki Hakata, Hiroshima (JP); Hiroomi Kakihara, Otake (JP); Masaaki Fukugauchi, Hiroshima (JP); Kenji Okada, Yokohama (JP); Yushi Mikuriya, Numazu (JP); Kazumi Yoshizaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/434,403

(22) Filed: Nov. 5, 1999

(30) Foreign Application Priority Data

Nov. 6, 1998 (JP) ..... 10-315235
Nov. 6, 1998 (JP) ..... 10-315236

(51) Int. Cl.[7] ..... G03G 9/113

(52) U.S. Cl. ..... 430/111.33; 430/111.31; 430/111.32; 430/111.35

(58) Field of Search ..... 430/106.6, 108, 430/106.1, 110.2, 108.1, 111.31, 111.32, 111.33, 111.35

(56) References Cited

U.S. PATENT DOCUMENTS

| | | | | |
|---|---|---|---|---|
| 5,512,402 A | | 4/1996 | Okado et al. | 430/106.6 |
| 5,641,600 A | | 6/1997 | Kotaki et al. | 430/106.6 |
| 5,766,814 A | | 6/1998 | Baba et al. | 430/106.6 |
| 5,774,771 A | | 6/1998 | Kukimoto et al. | 599/233 |
| 6,017,667 A | * | 1/2000 | Hakata | 430/106.6 |
| 6,106,987 A | * | 8/2000 | Hakata et al. | 430/108 |

FOREIGN PATENT DOCUMENTS

| | | |
|---|---|---|
| EP | 0708378 | 4/1996 |
| EP | 0708379 | 4/1996 |
| EP | 0801334 | 10/1997 |
| EP | 0801335 | 10/1997 |
| JP | 60-019156 | 1/1985 |
| JP | 60-140951 | 7/1985 |
| JP | 62-121463 | 6/1987 |
| JP | 04-198946 | 7/1992 |
| JP | 07-104522 | 4/1995 |

* cited by examiner

*Primary Examiner*—Christopher Rodee
(74) *Attorney, Agent, or Firm*—Fitzpatrick, Cella, Harper & Scinto

(57) ABSTRACT

A magnetic carrier exhibiting excellent durability against mechanical impact as exerted by vibration and capable of exhibiting a stable charging performance in electrophotography is provided. The magnetic carrier is formed through a process including steps of: surface treating inorganic compound particles with a lipophilizing agent having a functional group (A) selected from epoxy group, amino group, mercapto group, organic acid group, ester group, ketone group, halogenated alkyl group and aldehyde group; forming composite particles from the surface-treated inorganic compound particles and a binder resin; and then surface-coating the composite particles with a coupling agent having a functional group (B) different from the functional group (A) of the lipophilizing agent and selected from epoxy group, amino group and mercapto group, or with a coating resin having a functional group (C) different from the functional group (A) of the lipophilizing agent and selected from epoxy group, amino group, organic acid group, ester group, ketone group and halogenated alkyl group.

42 Claims, No Drawings

MAGNETIC CARRIER

FIELD OF THE INVENTION AND RELATED ART

The present invention relates to a magnetic carrier having excellent durability and exhibiting a correspondingly stable charging performance.

In electrophotographic processes, a photosensitive member comprising a photoconductive substance, such as selenium, OPC (organic photoconductor) or a-Si (amorphous-silicon) is used to form an electrostatic latent image thereon by various means. Such a latent image may be developed by a magnetic brush developing scheme by electrostatically attaching a toner charged to a polarity opposite to that of the latent image in a normal development mode or a toner charge to a polarity identical to that of the latent image in a reversal development scheme to visualize the latent image.

In the development, carrier particles called a magnetic carrier are used to impart an appropriate amount of positive or negative charge to a toner by triboelectrification and also convey the toner to a developing region in proximity to the surface of the photosensitive member having the latent image thereon under application of a magnetic force exerted from a magnet enclosed within a developing sleeve via the developing sleeve.

Hitherto, as such carrier particles, iron articles, ferrite particles and so-called binder-type particles that are composite particles formed by dispersing magnetic fine particles in a binder resin, have been proposed or commercialized. These carriers have widely ranging electrical resistivities from a low value as exhibited by iron particles to a high value as exhibited by the binder-type particles. Further, optimum resistivities are present depending on developing systems using them. For this reason, it has been frequently practiced to use such carrier particles as magnetic core particles and coating the core particles with various resins to adjust the resistivity.

In recent years, electrophotography has been widely adopted in copying machines and printers which are required to comply with various types of images including thin lines, small characters, photographic images and color originals. There are also demands for higher image quality, higher image speed and continuous image forming performances, and these demands are becoming more and more intense.

As carrier particles for complying with such demands, light-weight composite particles having a specific gravity of 2–4 have been widely used so as not to break the toner even under high-speed and continuous image formation.

There is an incessant demand for carrier particles having further improved performances, and particularly a magnetic carrier having a higher performance in charging a small-particle size toner for providing a higher quality of full-color images.

More specifically, it is important to impart a uniform charge to a toner, and to provide that the charging performance does not change during long hours of continuous use or against an environmental change. For exhibiting such performances, the magnetic carrier is required to exhibit an excellent durability.

Hitherto, as magnetic carriers having improved durability, there have been proposed various types of magnetic carriers inclusive of (1) a magnetic carrier obtained by surface coating magnetic carrier particles with a silicone resin coating layer comprising a silane coupling agent, etc. (Japanese Laid-Open Patent Application (JP-A) 60-140951, JP-A 62-121463 and JP-A 7-104522), (2) a magnetic carrier obtained by surface-coating magnetic carrier particles with a coupling agent and then with a silicone resin (JP-A 60-19156 and JP-A 62-121463), and (3) a magnetic carrier obtained by surface-coating magnetic carrier particles with an amino-silane coupling agent and then with a layer of coating resin having a functional group reactive with the amino-silane coupling agent (JP-A 4-198946).

In this way, magnetic carriers having excellent durability have been proposed, but such magnetic carriers having a satisfactory level of durability have not been obtained.

For example, the above-mentioned magnetic carrier or type (1) is liable to cause peeling of the coating layer after long hours of use, thus resulting in a change in charging performance leading to image problems as shown in Comparative Examples appearing hereinafter.

Regarding the above-mentioned magnetic carriers of types (2) and (3), the coupling agent is liable to be mixed within the coating resin layer during the resin coating thereon. As a result, insufficient adhesion between the magnetic carrier particles and the coating resin layer results, whereby the coating layer is liable to be peeled during long hours of use, thus resulting in image problems.

SUMMARY OF THE INVENTION

A generic object of the present invention is to provide a magnetic carrier having solved the above-mentioned problems of the conventional magnetic carriers.

A more specific object of the present invention is to provide a magnetic carrier for electrophotography exhibiting excellent durability, whereby when it is used in mixture with a toner in a developer even for a long period, the magnetic carrier does no cause the peeling of the coating layer but retains a stable charging performance, thus continually providing clear images.

According to the present invention, there is provided a magnetic carrier, comprising: composite particles each comprising at least inorganic compound particles and a binder resin, wherein said inorganic compound particles have been surface-treated with a lipophilizing agent having a functional group (A) selected from the group consisting of epoxy group, amino group, mercapto group, organic acid group, ester group, ketone group, halogenated alkyl group and aldehyde group, and said composite particles are surface-coated with a coupling agent having a functional group (B) different from the functional group (A) of the lipophilizing agent and selected from the group consisting of epoxy group, amino group and mercapto group.

According to another aspect of the present invention, there is provided a magnetic carrier, comprising: composite particles each comprising at least inorganic compound particles and a binder resin, wherein said inorganic carrier particles have been surface-treated with a lipophilizing agent having a functional group (A) selected from the group consisting or epoxy group, amino group, mercapto group, organic acid group, ester group, ketone group, halogenated alkyl group and aldehyde group, and said composite particles are surface-coated with a coating resin having a functional group (C) different from the functional group (A) of the lipophilizing agent and selected from the group consisting of epoxy group, amino group, organic acid group, ester group, ketone group and halogenated alkyl group.

The above mentioned and other objects and features of the invention will be better understood upon consideration of the following detailed description concluding with specific Examples and Comparative Examples.

DETAILED DESCRIPTION OF THE INVENTION

As a result of our investigation on the type of coated magnetic carriers obtainable by using composite particles comprising at least inorganic carrier particles and a binder resin as magnetic carrier core particles and forming a coating layer on the composite particles for suppressing the peeling of the coating layer, it has been found possible to effectively suppress the peeling of the coating layer by surface-treating the inorganic carrier particles with a lipophilizing agent having a specific functional group (A) and also surface-coating the composite particles with a coupling agent having a specific functional group (B) different from the functional group (A) or with a resin having a specific functional group (C) different from the functional group (A) to provide the coating layer.

Hereinbelow, the magnetic carrier obtained by coating the composite particles with the coupling agent is sometimes called "a first-type carrier", and the magnetic carrier obtained by coating the composite particles with the resin is sometimes called "a second-type carrier".

A most important feature of the first-type carrier of the present invention is that inorganic compound particles constituting the magnetic carrier core particles have been surface-treated with a lipophilizing agent having a functional group (A) selected from epoxy group amino group, mercapto group, organic acid group, ester group, ketone group, halogenated alkyl group and aldehyde group, and the carrier core particles including the treated inorganic compound particles are surface-coated with a coupling agent having a functional group (B) different from the functional group (A) and selected from epoxy group, amino group and mercapto group. As is understood from Examples appearing hereinafter, the resultant magnetic carrier is less liable to cause the peeling of the coupling agent coating the carrier core particles than known magnetic carriers.

We believe that the reduced peeling of the coupling agent coating the carrier core particles in the first-type carrier of the present invention is attributable to the formation of a coating layer of coupling agent excellent in uniformity and adhesion onto the surface of the carrier core particles through a reaction between the functional group (A) contained in the lipophilizing agent surface-treating the inorganic compound particles and the functional group (B) contained in the coating layer of the coupling agent.

The coating layer of the coupling agent in the first-type carrier can be further coated with a resin coating. The resin coating is also prevented from peeling due to the formation of the undercoating layer of the coupling agent excellent in uniformity and adhesion onto the surface of the carrier core particles.

A most important feature of the second-type carrier of the present invention is that inorganic compound particles constituting the magnetic carrier core particles have been surface-treated with a lipophilizing agent having a functional group (A) selected from epoxy group amino group, mercapto group, organic acid group, ester group, ketone group, halogenated alkyl group and aldehyde group, and the carrier core particles including the treated inorganic compound particles are surface-coated with a resin having a functional group (C) different from the functional group (A) and selected from epoxy group, amino group, organic acid group, ester group, ketone group and halogenated alkyl group. As is understood from Examples appearing hereinafter, the resultant magnetic carrier is less liable to cause the peeling of the resin coating the carrier core particles than known magnetic carriers.

We believe that the reduced peeling of the resin coating the carrier core particles in the second-type carrier of the present invention is attributable to the formation of a coating layer of resin excellent in uniformity and adhesion onto the surface of the carrier core particles through a reaction between the functional group (A) contained in the lipophilizing agent surface-treating the inorganic compound particles and the functional group (C) contained in the resin coating layer.

The resin coating layer in the second-type carrier can be further coated with a resin coating. The overlying resin coating is also prevented from peeling due to the formation of the undercoating resin layer excellent in uniformity and adhesion onto the surface of the carrier core particles.

As mentioned above, the magnetic carrier of the present invention comprises composite particles each comprising inorganic compound particles and a binder resin, and the composite particles are surface coated with a coupling agent or a resin.

The inorganic compound particles constituting the composite particles used in the present invention may comprise any materials which are not soluble in water and due not denaturate in contact with water.

The inorganic compound particles may include magnetic particles and non-magnetic particles. Examples of magnetic inorganic compound particles may preferably include particles of various magnetic iron compounds, such as magnetite, maghematite; composite magnetic iron oxides of these further containing one or more species of silicon oxide, silicon hydroxide, aluminum oxide or aluminum hydroxide; magnetoplumbite-form ferrites containing barium, strontium or barium-strontium; and spinel-form ferrites containing one or more species of manganese, nickel, zinc, lithium or magnesium. Among these, magnetic iron oxide particles may preferably be used. Examples of non-magnetic inorganic compound particles may include: particles of non-magnetic iron oxides such as hematite, nonmagnetic hydrous ferrite oxides, such as geothite, titanium oxide, silica, talc, alumina, barium sulfate, barium carbonate, cadmium yellow, calcium carbonate, and zinc white. Among these, non-magnetic iron oxide particles may preferably be used.

The inorganic compound particles may assume any shapes inclusive of cubic, polyhedral, spherical, acicular and plate-like. The inorganic compound particles may have any value of average particle size smaller than that of the composite particle, and may preferably have an average particle size in the range of 0.01–5.0 $\mu$m, particularly 0.1–2.0 $\mu$m.

In case where magnetic inorganic compound particles and nonmagnetic inorganic compound particles are used in mixture, it is preferred that the magnetic inorganic compound particles occupy at least 30 wt. % of the mixture.

In such a mixture, it is preferred that the magnetic inorganic compound particles have an average particle size a and the nonmagnetic inorganic compound particle have an average particle size b satisfying a<b, particular 1.5a<b in case where a is in the range of 0.02–2 μm and b is in the range of 0.05–5 μm.

The inorganic compound particles used in the present invention may be wholly or partly treated with a lipophilizing agent.

The lipophilizing agent used in the present invention may comprise one or more species in mixture of organic compound having one or more functional groups (A) selected from epoxy group, amino group, mercapto group, organic acid group, ester group, ketone group, halogenated alkyl group and aldehyde group. Among these, in order to obtain composite particles having a uniform particle size distribution, it is preferred to use a functional group selected from epoxy group, amino group and mercapto group. Epoxy group is particularly preferred in order to obtain a magnetic carrier exhibiting a stable charging performance less susceptible to changes in temperature and/or humidity. As the organic compound having such a functional group, it is preferred to use a coupling agent, more preferably a silane coupling agent, a titanate coupling agent or an aluminum coupling agent. A silane coupling agent is particularly preferred.

The organic compounds having an epoxy group may include: epichlorohydrin, glycidol, and styrene-glycidyl (meth)acrylate copolymer.

The silane coupling agents having an epoxy group include: γ-glycidoxypropylmethyldemethoxysilane, γ-glycidoxypropyltrimethoxysilane, and β-(3,4-epoxycyclohexyl)trimethoxysilane.

The organic compounds having an amino group include: ethylenediamine, diethylenetriamine, and styrene-dimethylaminoethyl (meth)acrylate copolymer.

The silane coupling agents having an amino group may include: γ-aminopropyltrimethoxysilane, N-β-(aminoethyl)-γ-aminopropyltrimethoxysilane, N-β-(aminoethyl)-γ-aminopropylmethyldimethoxysilane, and N-phenyl-γ-aminopropyltrimethoxysilane.

The titanate coupling agents having an amino group include: isopropyltri(N-aminoethyl)titanate.

The organic compounds having a mercapto group include: mercaptoethanol and mercaptopropionic acid.

The silane coupling agents having a mercapto group include: γ-mercaptopropyltrimethoxysilane.

The organic compounds having an organic acid group include: oleic acid, stearic acid and styrene-acrylic acid copolymer.

The organic compounds having an ester group include: ethyl stearate and styrene-methyl methacrylate copolymer.

The organic compounds having a ketone group include: cyclohexanone, acetophenone and methyl ethyl ketone.

The organic compounds having a halogenated alkyl group include: chlorohexadecane and chlorodecane.

The organic compounds having an aldehyde group include: propionaldehyde and benzaldehyde.

The inorganic compound particles may preferably be treated with 0.1–5 wt. %, more preferably 0.1–4.0 wt. %, thereof of a lipophilizing agent.

If the treating amount is below 0.1 wt. %, it becomes difficult to realize the intimate adhesion of the coating layer of the coupling agent or resin onto the surface of the composite particles. Further because of insufficient lipophilization treatment, it becomes difficult to obtain composite particles having a high content of the inorganic compound particles.

In excess of 5.0 wt. %, the intimate adhesion of the silane coupling agent or resin coating layer can be realized, but the resultant composite particles are liable to agglomerate with each other so that the particle size control of the composite particles becomes difficult.

The binder resin for the inorganic compound particles to provide the composite particles may preferably comprise a thermosetting resin, examples of which may include: phenolic resin, epoxy resin, polyamide resin, melamine resin, urea resin, unsaturated polyester resin, alkyd resin, xylene-formaldehyde resin, acetoquanamine resin, furan resin, silicone resin, polyimide resin, and urethane resin. These resins may be used singly or in combination of two or more species, but may preferably comprise phenolic resin at least partially.

The composite particles may preferably comprise the binder resin and the inorganic compound particles in proportions of 1–20 wt. % and 80–99 wt. %, respectively.

The composite particles may preferably have an average particle size of 10–50 μm and particularly preferably be in the form of spherical particles having an average particle size of 15–45 μm. Further preferred properties thereof may include: a specific gravity of 2.5–4.5, preferably 2.5–4.0; a magnetization ($\sigma_{1000}$) as measured in a magnetic field of $10^6/4\pi \cdot At/m$ (1000 oersted) of 15–60 $Am^2/kg$, preferably 25–60 $Am^2/kg$; a residual magnetization ($\sigma_r$) of 0.1–20 $Am^2/kg$, preferably 0.1–10 $Am^2/kg$; and a resistivity of $5\times10^{11}$–$5\times10^{15}$ ohm.cm, preferably $5\times10^{11}$–$8\times10^{15}$ ohm.cm.

Next, the first-type carrier according to the present invention will be described in further detail.

The first-type carrier is obtained by surface-coating the above-mentioned composite particles with a coupling agent having at least one functional group (B) selected from epoxy group, amino group and mercapto group. The coupling agent may preferably be a silane coupling agent, particular a silane coupling agent having an amino group, especially a primary amino group. The functional group (B) contained in the coupling agent is required to be different from the functional group (A) for surface-treating the inorganic compound particles in the composite particles contained in the lipophilizing agent and may preferably be reactive with the functional group (A).

For example, in case where the functional group (B) contained in the coating coupling agent is epoxy group, the functional group (A) contained in the lipophilizing agent for surface treating the inorganic compound particles may preferably be at least one of amino group, mercapto group and organic acid group. In case where the functional group (B) is amino group, the functional group (A) may preferably be at least one of epoxy group, mercapto group, organic acid group, ester group, ketone group, halogenated alkyl group and aldehyde group. In case where the functional group (B) is mercapto group, the functional group (A) may preferably be at least one of amino group, epoxy group, organic acid group, ester group, ketone group and aldehyde group.

Incidentally, in case where the functional group (B) contained in the coating coupling agent and the functional group (A) contained in the lipophilizing agent for surface-treating the inorganic compound particles are e.g., both epoxy groups, they do not interact with each other, and in case where the functional groups (B) and (A) are both amino groups, they may form a weak hydrogen bond to exhibit some effect but the bonding force therebetween is weak, so that the coating layer is liable to cause peeling due to mechanical impact exerted in a durability or continuous image forming test as will be shown in Comparative Examples.

Examples of reactions between the functional groups (A) and (B) in case of silane coupling agents, for example, may be represented as follows:

(1) amino group and organic acid group

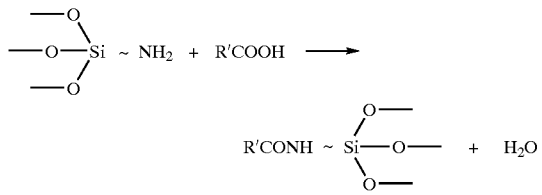

(2) amino group and ester group

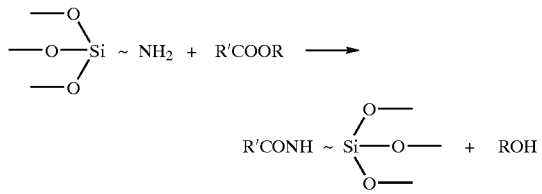

(3) amino group and aldehyde group

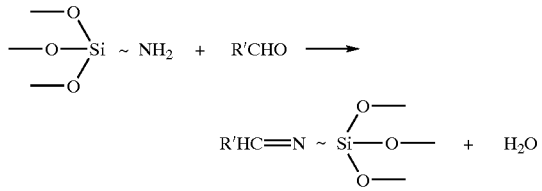

(4) amino group and ketone group

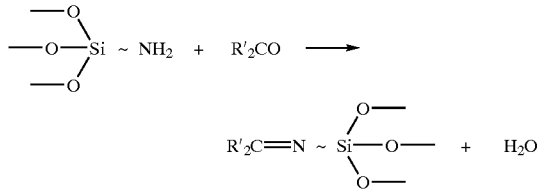

(5) amino group and halogenated alkyl group

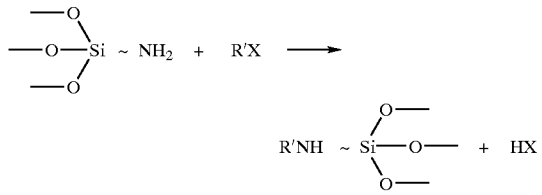

(6) amino group and epoxy group

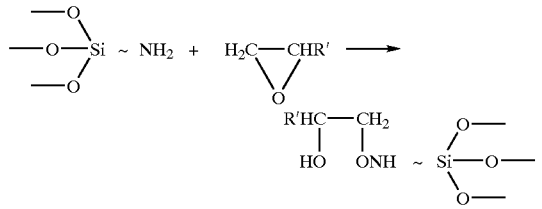

In the above reaction formulae (1)–(7), R represents an organic group, R' represents a silicone residue group, and "~" represents Si and Ni before and after it are connected with each other directly or with an intermediate bonding group.

The coating coupling agent for the first-type carrier may be any of the above-mentioned coupling agents used as the lipophilizing agent for surface-treating the inorganic compound particles, while the silane-based coupling agents are particularly preferred for retaining a high flowability of the resultant magnetic carrier.

The coupling agent may preferably be applied in a proportion of 0.001–5.0 wt. %, particularly 0.01–2.0 wt. % of the composite particles. Below 0.001 wt. %, it is difficult to have the coating of the coupling agent intimately adhere to the composite particle surface, thus being liable to result in deterioration of charging performance during continual use. Above 5.0 wt. %, the coating of the coupling agent can intimately adhere to the composite particle surface, but the charging performance can change during long hours of use due to the presence of excessive coupling agent.

In the case where the composite particles coated by the coupling agent are further coated with a resin, the coating resin may preferably be used in a proportion of 0.005–4.0 wt. %, particularly 0.05–2.0 wt. %, of the composite particles so as to provide an enhanced adhesion strength of the resin.

The first-type carrier coated with a coupling agent according to the present invention may preferably have an average particle size of 10–200 $\mu$m. Below 10 $\mu$m, so-called carrier attachment of the magnetic carrier particles per se jumping onto the photosensitive member which results in image defects, is liable to occur. Above 200 $\mu$m, it becomes difficult to attain clear images.

In order to provide particularly high image qualities, the first-type carrier particles may preferably have an average particle size in the range of 10–100 $\mu$m, more preferably 10–60 $\mu$m, further preferably 10–50 $\mu$m, most preferably 15–45 $\mu$m in view of excellent mixability with and conveyability of a replenishing toner even in case of continuous printing or copying of an original image having a high image proportion and requiring a large amount of toner consumption, such as photographic images.

Similarly as the composite particles, the first-type carrier coated with a coupling agent may preferably have properties, inclusive of: a specific gravity of 2.5–4.5, preferably 2.5–4.0; a magnetization ($\sigma_{1000}$) as measured in a magnetic field of $10^6/4\pi\cdot$At/m (1000 oersted) of 15–60 $Am^2/kg$, and preferably 25–60 $Am^2/kg$; a residual magnetization ($\sigma_r$) of 0.1–20 $Am^2/kg$, preferably 0.1–10 $Am^2/kg$.

It is further preferred that the magnetic carrier shows a triboelectric charging performance change ($\Delta Q_{TC}$ (%)), as will be described hereinafter of 0–25%, particularly 0–20%.

Next, the second-type carrier (magnetic carrier) according to the present invention will be described.

The second-type carrier is obtained by surface-coating the above-mentioned composite particles with a coating resin having at least one functional group (C) selected from epoxy group, amino group, organic acid group, ester group, ketone group and halogenated alkyl group. The functional group (C) contained in the coating resin is required to be different from the functional group (A) for surface-treating the inorganic compound particles in the composite particles contained in the lipophilizing agent and may preferably be reactive with the functional group (A).

For example, in case where the functional group (C) contained in the coating resin is epoxy group, the functional group (A) contained in the lipophilizing agent for surface treating the inorganic compound particles may preferably be at least one of amino group, mercapto group and organic acid group. In case where the functional group (C) is amino group, the functional group (A) may preferably be at least one of epoxy group, mercapto group, organic acid group, ester group, ketone group, halogenated alkyl group and aldehyde group. In case where the functional group (C) is an organic acid group, the functional group (A) may preferably be at least one of amino group, epoxy group, mercapto group, ester group, ketone group, halogenated alkyl group and aldehyde group. In case where the functional group (C) is an ester group, the functional group (A) may preferably be at least one of amino group, mercapto group, organic acid group, ketone group, halogenated alkyl group and aldehyde group. In case where the functional group (C) is a ketone group, the functional group (A) may preferably be at least one of amino group, mercapto group, organic acid group, ester group, halogenated alkyl group and aldehye group. In case where the functional group (C) is a halogenated alkyl group, the functional group (A) may preferably be at least one of amino group, epoxy group, organic acid group, mercapto group, ester group, ketone group and aldehyde group.

Incidentally, in case where the functional group (C) contained in the coating coupling agent and the functional group (A) contained in the lipophilizing agent for surface-treating the inorganic compound particles are e.g., both epoxy groups, they do not interact with each other, and in case where the functional groups (C) and (A) are both amino groups, they may form a weak hydrogen bond to exhibit some effect but the bonding force therebetween is weak, so that the coating layer is liable to cause peeling due to mechanical impact exerted in a durability or continuous image forming test as will be shown in Comparative Examples.

Examples of reactions between the functional groups (A) and (C) in case of silane coupling agents may also be represented by the above-mentioned reaction formulae (1)–(7), for the reactions between the functional groups (A) and (B).

Examples of the coating resin having a functional group (C) may include: resin compositions having an epoxy group, such as epoxy, epoxy-modified silicone resin, and copolymers of styrene with a monomer having an epoxy group, such as glycidyl (meth)acrylate; resin compositions having an amino group, such as polyamide resin, urea-formalin resin, aniline resin, melamine-formalin resin, guanamine resin, and copolymers of styrene with an amino group-containing monomer, such as dimethylaminoethyl (meth) acrylate or diethylaminoethyl (meth)acrylate; resin compositions having an organic acid group, such as polyacrylic acid and copolymer of styrene and acrylic acid; resin compositions having an acid group, such as polyester resin, (meth)acrylate resin, acrylate-modified silicone resin, alkyd-modified silicone resin, and copolymers of styrene and (meth)acrylate; resin compositions having a ketone group, such as methyl ethyl ketone resin; and resin compositions having a halogenated alkyl group such as polyvinyl chloride and polyvinylidene chloride.

The coating resin having a functional group (C) may preferably be applied in a proportion of at least 0.05 wt. % of the composite particles. Below 0.05 wt. %, the resultant coating film is liable to be insufficient and ununiform, so that the control of the charging performance becomes difficult. If the coating amount is excessive, the resultant magnetic carrier is liable to have too high a resistivity, thus resulting in image defects. The coating amount is more preferably 0.1–10 wt. %, further preferably 0.2 –5.0 wt. %.

The second-type carrier having a resin coating according to the present invention may preferably have an average particle size of 10–200 $\mu$m. Below 10 $\mu$m, so-called carrier attachment of the magnetic carrier particles per se jumping onto the photosensitive member which results in image defects, is liable to occur. Above 200 $\mu$m, it becomes difficult to attain clear images.

In order to provide particularly high image qualities, the second-type carrier particles may preferably have an average particle size in the range of 10–100 $\mu$m, more preferably 10–60 $\mu$m, further preferably 10–50 $\mu$m, most preferably 15–45 $\mu$m in view of excellent mixability with and conveyability of a replenishing toner even in case of continuous printing or copying of an original image having a high image proportion and requiring a large amount of toner consumption, such as photographic images.

Similarly as the composite particles, the second-type carrier coated with a resin having a functional group (C) may preferably have properties, inclusive of: a specific gravity of 2.5–4.5, preferably 2.5–4.0; a magnetization ($\sigma_{1000}$) as measured in a magnetic field of $10^6/4\pi \cdot$At/m (1000 oersted) of 15–60 $Am^2/kg$, and preferably 25–60 $Am^2/kg$; a residual magnetization ($\sigma_r$) of 0.1–20 $Am^2/kg$, preferably 0.1–10 $Am^2/kg$.

It is further preferred that the second-type carrier shows a triboelectric charging performance change ($Q_{TC}$ (%)), as will be described hereinafter of 0–25%, particularly 0–20%.

In the second-type carrier according to the present invention, the coating layer of the resin having a functional group (C) can further contain a coupling agent, as desired, in an amount of 0.1–20 wt. % of the solid resin content. The coupling agent may preferably be a silane-based coupling agent. The amount of the coupling agent is further preferably 0.1–10.0 wt. % of the solid resin content so as to prevent a lowering in strength due to self-condensation of the coupling agent.

The coating layer of the resin having a functional group (C) may optionally be coated with a further resin coating layer.

Any known resin may be used to provide such a further resin coating layer optionally formed on the coating layer of a coupling agent having a functional group (B) (in the first-type carrier) or a coating resin having a functional group (C) (in the second-type carrier). Examples thereof may include: epoxy resin, silicone resin, polyester resin, fluorine-containing resin, styrene resin, acrylic resin and phenolic resin. Polymers obtained by polymerization of monomers may also be used. Silicone resin is particularly a preferred in view of durability and anti-soiling characteristic.

Such a further resin coating layer, when formed, may preferably be formed in a proportion of at least 0.05 wt. % of the composite particles. Below 0.05 wt. %, the resultant coating film is liable to be insufficient and ununiform, so that control of the charging performance becomes difficult. If the coating amount is excessive, the resultant magnetic carrier is liable to have an excessively high resistivity, thus resulting in defective images. The coating amount is more preferably 0.1–10 wt. %, further preferably 0.2–5 wt. %, so as to avoid coalescence of the particles during the resin coating.

The magnetic carrier having such a further resin coating layer according to the present invention may preferably have an average particle size of 10–200 $\mu$m. Below 10 $\mu$m, so-called carrier attachment of the magnetic carrier particles per se jumping onto the photosensitive member results in image defects, is liable to occur. Above 200 $\mu$m, it becomes difficult to attain clear images.

In order to provide particularly high image qualities, the magnetic carrier particles may preferably have an average particle size in the range of 10–100 $\mu$m, more preferably 10–60 μm, further preferably 10–50 μm, most preferably 15–45 μm in view of excellent mixability with and conveyability of a replenishing toner even in case of continuous printing or copying of an original image having a high image proportion and requiring a large amount of toner consumption, such as photographic images.

Similarly as the composite particles, the magnetic carrier particles having such a further coating layer may preferably have properties, inclusive of: a specific gravity of 2.5–4.5, preferably 2.5–4.0; a magnetization ($\sigma_{1000}$) as measured in a magnetic field of $10^6/4\pi \cdot$At/m (1000 oersted) of 15–60 $Am^2/kg$, and preferably 25–60 $Am^2/kg$; a residual magnetization ($\sigma_r$) of 0.1–20 $Am^2/kg$, preferably 0.1–10 $Am^2/kg$.

It is further preferred that the magnetic carrier shows a triboelectric charging performance change ($\Delta Q_{TC}$ (%)), as will be described hereinafter of 0–25%, particularly 0–20%.

Next, a process for producing the magnetic carrier according to the present invention will be described.

The treatment of the inorganic compound particles with a lipophilizing agent may be performed by adding a solution of a coupling agent or an organic compound as the lipophilizing agent to the inorganic compound particles and blending them to coat the inorganic compound with the lipophilizing agent.

The composite particles may be formed through a so-called polymerization process wherein the lipophilized inorganic compound particles are dispersed together with a monomer and a catalyst or initiator in a liquid dispersion medium capable of dissolving the monomer, and the mixture is subjected to polymerization under stirring to form composite particles comprising the inorganic compound particles and a binder resin formed by polymerization of the monomer, or a kneading-pulverization process wherein a kneaded product of a binder resin containing the lipophilized inorganic compound particles dispersed therein is pulverized into particles. The polymerization process is preferred in order to easily control the particle size of the magnetic carrier and provide a sharp particle size distribution.

The preparation of composite particles using a phenolic resin may be performed, e.g., by dispersing a phenol, an aldehyde and the lipophilized inorganic compound particles in an aqueous medium, and reacting the phenol and the aldehyde in the presence of a basic catalyst under stirring to form composite particles comprise the inorganic particles and the phenolic resin. It is also possible to produce a modified phenolic resin by using the phenol in mixture with a natural resin, such as rosin, or a drying oil, such as tung oil or linseed oil, for the reaction. In this case, the average particle size of the resultant composite particle size may be controlled within a desired range by controlling the species and amount of the inorganic compound particles, the amount of the aqueous dispersion medium and the stirring speed so as to apply appropriate shearing and compression forces.

Phenolic resin is particularly preferred as the binder resin since it retains a moderate level of absorbed water to promote the hydrolysis of the coupling agent, thus forming a touch coating.

The preparation of composite particles using an epoxy resin as the binder resin may be performed, e.g., by dispersing a bisphenol, an epihalohydrin and the lipophilized inorganic compound particles in an aqueous medium, and reacting the bisphenol and the epichlorohydrin in an alkaline aqueous medium.

The preparation of composite particles using a melamine resin as the binder resin may be performed, e.g., by dispersing a melamine, an aldehyde and the lipophilized inorganic compound particles in an aqueous medium, and reacting the melamine and the aldehyde in the presence of a weak acid catalyst.

The preparation of composite particles using other thermosetting resins may be performed, e.g., by kneading the lipophilized inorganic compound particles together with various resins, pulverizing the kneaded product into particles and subjecting the particles to a sphering treatment.

The thus-produced composite particles comprising the lipophilized inorganic compound particles and the binder resin may be subjected to a heat treatment, as desired, so as to further cure the resin. The heat treatment may preferably be performed under a reduced pressure or in an inert gas atmosphere so as to avoid the oxidation of the inorganic compound particles.

The coating of the composite particles with a coupling agent for providing the first-type carrier may be performed by an ordinary method, such as a method of dipping the compound particles in a solution of the coupling agent in water or a solvent, and filtering and drying the dipped particles, or a method of spraying a solution of the coupling agent in water or a solvent onto the composite particles under stirring, followed by drying. The treatment under stirring is particularly preferred in order to prevent the coalescence of the composite particles and to form a uniform coating layer.

The coating of the composite particles with a coating resin for providing the second-type carrier may be performed by a known method, such as a method of dry-blending the composite particles and coating resin particles by means of, e.g., a Henschel mixer or a high-speed mixer, a method of impregnating the composite particles with a solution of the coating resin, or a method of spraying the coating resin onto the composite particles by means of a spray dryer.

It is also possible to adopt a method of reacting a phenol and an aldehyde, or a melamine and an aldehyde, in the presence of composite particles in an aqueous medium to coat the composite particles with a phenolic resin or a melamine resin; a method of polymerizing acrylonitrile and another vinyl monomer in the presence of composite particles in an aqueous medium to coat the particles with an acrylonitrile copolymer, or a method of subjecting a lactam to anionic polymerization in the presence of composite particles to coat the particles with a polyamide resin.

The optional coating of the coated magnetic carrier (first-type carrier or second-type carrier) with a further resin coating layer may be performed by a known method, such as a method of dry-blending the coated magnetic carrier particles and particles of such a further resin by means of, e.g., a Henschel mixer or a high-speed mixer, a method of impregnating the coated magnetic carrier particles with a solution of the coating resin, or a method of spraying the further coating resin onto the coated magnetic carrier particles by means of a spray dryer.

It is also possible to adopt a method of reacting a phenol and an aldehyde, or a melamine and an aldehyde, in the presence of composite particles in an aqueous medium to coat the composite particles with a phenolic resin or a melamine resin; a method of polymerizing acrylonitrile and another vinyl monomer in the presence of coated magnetic carrier particles in an aqueous medium to further coat the particles with an acrylonitrile copolymer, or a method of subjecting a lactam to anionic polymerization in the presence of composite particles to further coat the particles with a polyamide resin.

The magnetic carrier according to the present invention intimately and uniformly coated with a coating layer of a coupling agent having a functional group (B) or a resin having a functional group (C) with a stronger adhesion than the conventional level onto the composite particles, is less liable to cause a peeling of the coating layer but capable of exhibiting a stable charging performance even after long hours of use, thus being suitably used as a magnetic carrier for electrophotography. As a result, it is possible to provide excellent image-forming performances inclusive of uniformly high image density, solid image uniformity and fog-suppression characteristic.

The organisation and effect of the magnetic carrier according to the present invention will be more specifically clarified based on the following Examples and Comparative Examples. First, methods for measuring various properties described herein, a production examples of toner to be used together with carriers and methods for evaluating image forming performances, are described.

(Measurement methods for various properties)

Average particle sizes described herein mean weight-average particle sizes measured by using a laser diffraction-type particle size distribution meter (mfd. by Horibna Seisakusho K.K.), and particle shapes are based on observation through a scanning electron microscope ("S-800", mfd. by K.K. Hitachi Seisakusho).

Sphericity is calculated according to the following equation from an average longer-axis diameter 1 and an average shorter-axis diameter w based on observation of at least 250 particles selected at random on photographs taken through the scanning electron microscope ("S-800"):

$$\text{Sphericity } (\Phi_{sp})=1/w.$$

Magnetization ($\sigma_{1000}$) and residual magnetization ($\sigma_r$) are based on values measured at an external magnetic field of 1 kOe ($=10^6/4\pi\cdot AT/m$) by using a vibrating sample-type magnetometer ("VSM-3S-15", mfd. by Toei Kogyo K.K.).

True specific gravities ($\rho_{sq}$) are based on values measured by using a multi-volume densitometer (mfd. by Micromeritices Corp.).

Volume resistivities (Rv) are based on values measured by using a high resistance meter ("4329A", mfd. by Yokogawa Hewlet-Packard K.K.).

Charges (triboelectric charges) $Q_{TC}$ given by a magnetic carrier were measured before and after a durability test.

The durability test was performed by placing 50 g of a magnetic carrier sample in a 100 cc-glass bottle. After closing the bottle with a lid, the bottle was vibrated for 10 hours on a paint condition (mfd. by Red Devil Co.). Each magnetic carrier sample was subjected to measurement of triboelectric charge $Q_{TC}$ given to a toner sample before the vibration ($Q_{TC1}$) and after the vibration ($Q_{TC2}$). The durability in terms of a triboelectric charging performance charge $\Delta Q_{TC}$ (%) was evaluated by an equation of:

$$\Delta Q_{TC}\ (\%)=[(Q_{TC1}-Q_{TC2})/Q_{TC1}]\times 100$$

For the measurement of $Q_{TC}$, 95 wt. parts of a magnetic carrier sample before or after the vibration was mixed with 5 wt. parts of a toner produced in Toner Production Example described below, and the mixture was subjected to measurement of a triboelectric charge $Q_{TC}$ ($\mu$C/g-toner) by a blow-off charge measurement apparatus ("TB-200", mfd. by Toshiba Chemical K.K.).

(Toner Production Example)

| | |
|---|---|
| Polyester resin (condensation product among propoxidized bisphenol, fumaric acid and trimellitic acid) | 100 wt. parts |
| Carbon black | 4 wt. parts |
| Charge control agent (di-t-butylsalicylic acid zinc compound) | 2 wt. parts |
| Low-molecular weight polyolefin | 4 wt. parts |

The above ingredients were sufficiently preliminarily blended by a Henschel mixer, and then melt-kneaded by a twin-screw extrusion kneader. After cooling, the kneaded product was coarsely crushed to ca. 1–2 mm by a hammer mill and then finely pulverized by an air jet-type pulverizer, followed by classification by a multi-division pneumatic classifier to obtain a black powder having a weight-average particle size of 7.5 $\mu$m.

100 wt. parts of the black powder was blended with 1 wt. part of hydrophobic titanium oxide by a Henschel mixer to obtain a black toner.

(Image-Forming Performances)

The durability of a toner regarding image forming performances were evaluated with respect to image density, solid image uniformity and fog in a continuous image forming test.

More specifically, a continuous copying test was performed on 10,000 sheets by using a commercially available full-color copying machine ("CLC700", mfd. by Canon K.K.) and an original using an image percentage of 10% by using a developer mixture of the black toner (of Toner Production Example) and a magnetic carrier sample at a toner concentration of 5 wt. %. Evaluation was performed in the following manner.

Image density was obtained as an average of image densities measured at centers of 5 solid circle images obtained as a reproduction of an original including 5 solid circles each having a diameter of 20 mm and an image density of 1.5 by a reflection densitometer ("RD918", mfd. by Macbeth Co.).

Solid image uniformity was evaluated based on a difference ($\Delta D=Dmax-Dmin$) between a maximum image density (Dmax) and a minimum density (Dmin) among the 5 measured values of the reproduced images with respect to the original including 5 solid circles of 20 mm in diameter and a reflection image density of 1.5 according to the following standard:

A: $\Delta D \leqq 0.04$,

B: $0.04<\Delta D \leqq 0.08$

C: $0.08 \leqq \Delta D \leqq 0.12$

D: $\Delta D>0.12$

Fog was evaluated based on a fog value defined as a difference (=Dr−Ds) between a maximum (Dr) of image density among reflection image densities measured at 10 points in a non-image area (white background) on a reproduced image sheet and an average (Ds) of reflection image densities measured at 10 points on a blank white paper before use for the image formation according to the following standard:

A: $Dr-Ds \leqq 0.4$[{]p1B: $0.5\%<Dr-Ds \leqq 0.8\%$

C: $0.08\% \leqq Dr-Ds \leqq 1.2\%$

D: $Dr-Ds>1.2\%$

The reflection image densities were measured by using a reflection densitometer ("REFLECTOMETER MODEL TC-6DS", mfd. by Tokyo Denshoku K.K.).

EXAMPLES

<Production of Magnetic Carrier Core Particles>

Carrier Core Particles A

Into a Henschel mixer, 500 g of spherical magnetite particles having an average particle size (Dav) of 0.24 μm and carrying aluminum oxide at the surface and 500 g of hematite particles (Dav=0.4 μm) were charged and sufficiently blended with each other, and to the blend under stirring, 7.5 g of a silane coupling agent having an epoxy group ("KBM-504", mfd. by Shin-Etsu Kaguku Kogyo K.K.) was added and mixed to surface-treat the mixture oxide particles.

A 1 liter-flask was charged with 125 g of phenol, 187.5 g of 37%-formalin, 1 kg of the above-prepared surface-treated mixture oxide particles, 37.5 g of 25%-ammonia water and 125 g of water. The mixture was heated under stirring up to 85° C. in 60 min., and reacted for curing at that temperature for 120 min. to produce composite particles comprising a phenolic resin and inorganic compound particles.

Then, the content in the flask was cooled to 30° C. and transferred to a 3 liter-flask, to which 1.5 liter of water was added. After the supernatant liquid was removed, the precipitate in the lower layer was recovered, washed with water and dried in air. The air-dried precipitate was further dried at 150–180° C. under a reduced pressure (of 5 mmHg or below) to obtain composite particles (called hereinafter "Carrier core particles A").

Carrier core particles A were spherical particles (sphericity ($\phi_{sp}$=1.1) comprising 44.0 wt. % of spherical magnetite particles carrying aluminum oxide at the surface of 44.2 wt. % of hematite particles, and exhibited Dav=35 μm, a specific gravity ($\rho_{sq}$)=3.55, a magnetization of a 1000 oersted magnetic field ($\sigma_{1000}$)=29 $Am^2$/kg, a residual magnetization ($\sigma_r$)=3.0 $Am^2$/kg and a volume resistivity (Rv)= $1\times10^{12}$ ohm.cm.

Carrier Core Particles B

Into a Henschel mixer, 1000 g of spherical magnetite particles (Dav=0.31 μm) was charged, and under sufficient stirring, 5.0 g of a silane coupling agent having an amino group ("KBM-602", mfd. by Shin-Etsu Kagaku Kogyo K.K.) was added and mixed to surface-treat the magnetite particles.

1 liter four-necked flask was charged with 250 ml of water, 27.5 g of sodium hydroxide, 100 g of bisphenol A, 50 g of epichlorohydrin, 10 g of phthalic anhydride and 1 kg of the above-prepared surface-treated magnetite particles. The mixture under stirring was heated to 85° C. and held for 2 hours at that temperature to produce composite particles.

Then, the content in the flask was cooled to 30° C., and 1.5 liter of water was added thereto. After the supernatant liquid was removed, the precipitate in the lower layer was recovered, washed with water and dried to obtain Carrier core particles B.

Carrier core particles B were spherical particles ($\phi_{sp}$=1.1) comprising 87.6 wt. % of spherical magnetite particles and exhibited Dav=25 μm, $\rho_{sq}$=3.52, $\sigma_{1000}$=58 $Am^2$/kg, $\sigma_r$=5.1 $Am^2$/kg, and Rv=$4\times10^7$ ohm.cm.

Carrier Core Particles C

A mixture of 800 g of spherical magnetite particles (Dav=0.31 μm) and 200 g of hematite particles (Dav=0.60 μm) was lipophilized with 0.50 wt. % thereof of a silane coupling agent having an epoxy group ("KBM-403", mfd. by Shin-Etsu Kagaku Kogyo K.K.) similarly as in the production of Carrier core particles A described above.

A 1 liter four-necked flask was charged with 120 g of phenol, 182.5 g of 37%-formalin, 1 kg of the above-lipophilized mixture particles, 33.5 g of 25%-ammonia water, and 110 g of water. The mixture was heated under stirring up to 85° C. in 60 min., and reacted for curing at the temperature for 120 min. to produce composite particles comprising a phenolic resin and the lipophilized mixture particles.

Then, the content of the flask was cooled to 30° C., and 1.5 liter of water was added thereto. Then, after removing the supernatant liquid, the precipitate in the lower layer was washed with water and dried in air to obtain composite particles (Carrier core particles C).

Carrier core particles C were spherical particles ($\phi_{sp}$=1.2) comprising 70.4 wt. % of the spherical magnetite particles and 17.7 wt. % of the hematite particles, and exhibited Dav=45 μm, $\rho_{sq}$3.56, $\sigma_{1000}$=46 $Am^2$/kg, $\sigma_r$=4.5 $Am^2$/kg and Rv=$2\times10^9$ ohm. cm.

Carrier Core Particles D

A mixture of 900 g of spherical magnetite particles (Dav=0.24 μm) and 100 g of titanium oxide particles (Dav= 0.30 μm) was lipophilized with 0.70 wt. % thereof of a silane coupling agent having an amino group ("KBM-602", mfd. by Shin-Etsu Kagaku Kogyo K.K.) similarly as in the production of Carrier core particles A described above.

A 1 liter four-necked flask was charged with 130 g of phenol, 185 g of 37%-formalin, 1 kg of the above-lipophilized mixture particles, 35 g of 25%-ammonia water, and 110 g of water. The mixture was heated under stirring up to 85° C. in 60 min., and reacted for curing at the temperature for 120 min. to produce composite particles comprising a phenolic resin and the lipophilized mixture particles.

Then, the content of the flask was cooled to 30° C. and 1.5 liter of water was added thereto. Then, after removing the supernatant liquid, the precipitate in the lower layer was washed with water and dried in air to obtain composite particles (Carrier core particles D).

Carrier core particles D were spherical particles ($\phi_{sp}$=1.2) comprising 70.4 wt. % of the spherical magnetite particles and 17.7 wt. % of the titanium oxide particles, and exhibited Dav=50 μm, $\rho_{sq}$=3.57, $\sigma_{1000}$=52 $Am^2$/kg, $\sigma_r$=4.8 $Am^2$/kg and Rv=$2\times10^8$ ohm.cm.

Carrier Core Particles E 1000 g of polyhedral magnetite particles (Dav=0.26 μm) was lipophilized with 0.50 wt. % thereof of a silane coupling agent having an amino group ("KBM-602", mfd. by Shin-Etsu Kagaku Kogyo K.K.) similarly as in the production of Carrier core particles A described above.

A 1 liter four-necked flask was charged with 250 ml of water, 30 g of sodium hydroxide, 110 g of bisphenol A, 55 g of epichlorohydrin, 12 g of phthalic anhydride, and 1 kg of the above-lipophilized magnetite particles. The mixture was heated under stirring up to 85° C., and reacted for curing at the temperature for 120 min. to produce composite particles.

Then, the content of the flask was cooled to 30° C., and 1.5 liter of water was added thereto. Then, after removing the supernatant liquid, the precipitate in the lower layer was washed with water and dried in air to obtain composite particles (Carrier core particles E).

Carrier core particles E were spherical particles ($\phi_{sp}$=1.2) comprising 87.2 wt. % of the polydegral magnetite particles and exhibited Dav=60 $\mu$m, $\rho_{sq}$=3.56, $\sigma_{1000}$=57 $Am^2/kg$, $\sigma_r$=7.0 $Am^2/kg$ and Rv=$2\times10^7$ ohm.cm.

<Surface-Coating with a Coupling Agent of Magnetic Carrier Core Particles>

Example 1

In a universal stirrer ("5XDML", mfd. by K. K. Dalton), Carrier core particles A were placed and stirred until the internal (material) temperature reached 50° C. Then, a silane coupling agent having an amino group ("KBM-602", mfd. by Shin-Etsu Kagaku Kogyo K.K.) in an amount of 0.3 wt. % of the core particles in solution within methanol was added and the internal temperature was heated up to 70° C. The stirring was further continued for 2 hours at the temperature to provide a magnetic carrier comprising Carrier core particles A coated with an amino group-containing silane coupling agent (hereinafter called "Magnetic carrier particles I").

As a result of observation through an electron microscope, the coating with the coupling agent was sufficient and uniform at a coating rate of 0.23 wt. %. As is also shown in Table 1, Magnetic carrier particles I exhibited Dav=35 $\mu$m, a bulk density ($d_B$)=1.88 g/ml, $\rho_{sq}$=3.53, Rv=$6\times10^{11}$ ohm.cm, $\sigma_{1000}$=29 $Am^2/kg$, $\sigma_r$=3.0 $Am^2/kg$, and a triboelectricity change=8% ($Q_{TC}$=−60 $\mu$m/g and −55 $\mu$C/g, before and after vibration, respectively). Magnetic carrier particles I also exhibited image-forming performance as shown in Table 3.

Example 2

In a universal stirrer ("5XDML", mfd. by K. K. Dalton), Carrier core particles A were placed and stirred until the internal temperature reached 50° C. Then, a silane coupling agent having an amino group ("KBM-903", mfd. by Shin-Etsu Kagaku Kogyo K.K.) in an amount of 0.15 wt. % of the core particles in solution within methanol was added and the internal temperature was heated up to 70° C. The stirring was further continued for 2 hours at the temperature to provide a magnetic carrier comprising Carrier core particles A coated with an amino group-containing silane coupling agent (hereinafter called "Magnetic carrier particles II"), which exhibited properties shown in Table 1 and image forming performances shown in Table 3.

Examples 3–7 and Comparative Examples 1–3

Magnetic carrier particles III–X were prepared in the same manner as in Example 1 except for changing the carrier core particles and changing the use or non-use, the species (of a functional group) and the weight (coating rate) of the coupling agent. Magnetic carrier particles III to VII obtained in Examples 3–7 all exhibited sufficient and uniform coating with the coupling agent.

Magnetic carrier particles III–X respectively exhibited properties shown in Table 1 and image-forming performances shown in Table 3.

Magnetic carrier particles VIII of Comparative Example 1 were Carrier core particles A per se without the coating with a coupling agent.

Magnetic carrier particles IX and X prepared in Comparative Examples 2 and 3, respectively, were each prepared by using a coating coupling agent having a functional group (B) identical in species to the functional group (A) in the lipophilizing agent for surface treating the oxide particles in the carrier core particles.

As a result, Magnetic carrier particles IX and X exhibited a somewhat larger change in triboelectric charge ($Q_{TC}$) after the vibration. This may be attributable to a weak adhesion of the coating layer onto the carrier core particles due to the use of identical species (epoxy group in Comparative Example 2 and amino group in Comparative Example 3) for the functional group (A) of the lipophilizing agent and the functional group (B) of the coupling agent, thus resulting in peeling of the coating layer due to a mechanical impact in the vibration durability test leading to a change in triboelectric charge.

TABLE 1

| | Coating with a coupling agent | | | | | | | | | | | | | | | |
|---|---|---|---|---|---|---|---|---|---|---|---|---|---|---|---|---|
| | | | | | | Magnetic carrier | | | | | | | | | | |
| | | | | | | | | | | | | | Charging performance | | | |
| | Carrier core | | Coating coupling agent | | | | | | | | $\sigma_{1000}$ | $\sigma_r$ | $Q_{TC1}$ | $Q_{TC2}$ | | |
| Ex. or Comp. Ex. | Name | Qty. (g) | F.G.* | Name | Qty. (g) | Dav. ($\mu$m) | $d_B$ (g/ml) | $\rho_{sq}$ | Coat. (wt. %) | Rv (ohm.cm) | ($Am^2$/kg) | ($Am^2$/kg) | ($\mu$C/g) | ($\mu$C/g) | $\Delta Q_{TC}$ (%) | Name |
| Ex. | | | | | | | | | | | | | | | | |
| 1 | A | 1000 | amino | KBM602 | 3.0 | 35 | 1.88 | 3.53 | 0.23 | $6\times10^{11}$ | 29 | 3.0 | −60 | −55 | 8 | I |
| 2 | A | 1000 | amino | KBM903 | 1.5 | 35 | 1.89 | 3.53 | 0.12 | $8\times10^{11}$ | 29 | 3.0 | −57 | −52 | 9 | II |
| 3 | B | 1000 | epoxy | KBM403 | 0.8 | 25 | 1.76 | 3.52 | 0.06 | $7\times10^{7}$ | 58 | 5.1 | −28 | −23 | 18 | III |
| 4 | D | 1000 | mercapto | KBM803 | 0.7 | 51 | 1.92 | 3.57 | 0.05 | $5\times10^{7}$ | 52 | 4.8 | −24 | −20 | 17 | IV |
| 5 | C | 1000 | amino | KBM903 | 3.0 | 45 | 1.90 | 3.57 | 0.21 | $8\times10^{8}$ | 47 | 4.5 | −55 | −52 | 5 | V |
| 6 | E | 1000 | epoxy | KBM402 | 2.2 | 60 | 1.92 | 3.54 | 0.17 | $7\times10^{7}$ | 57 | 7.0 | −27 | −25 | 7 | VI |
| 7 | A | 1000 | amino | KBM903 | 5.0 | 35 | 1.89 | 3.53 | 0.32 | $7\times10^{11}$ | 29 | 3.0 | −72 | −68 | 6 | VII |
| Comp. Ex. | | | | | | | | | | | | | | | | |
| 1 | A | 1000 | — | — | — | 35 | 1.89 | 3.55 | 0 | $1\times10^{12}$ | 29 | 3.0 | −15 | −10 | 33 | VIII |
| 2 | A | 1000 | epoxy | KBM402 | 1.7 | 35 | 1.83 | 3.55 | 0.11 | $5\times10^{8}$ | 29 | 3.0 | −25 | −18 | 28 | IX |
| 3 | E | 1000 | amino | KBM903 | 1.5 | 35 | 1.85 | 3.54 | 0.12 | $8\times10^{7}$ | 57 | 7.0 | −55 | −23 | 40 | X |

*F.G. = Functional group.

<Further Coating with a Resin of Coupling Agent-Coated Magnetic Carrier Core Particles>

Example 8

1 kg of Magnetic carrier particles—were stirred at 70° C. in a universal stirrer ("5XDML"), and a solution of 10 g as solid of a silicone resin ("KR-221", mfd. by Shin-Etsu Kagaku Kogyo K.K.) and 0.3 g of a coupling agent ("KBM-903", mfd. by Shin-Etsu Kagaku Kogyo K.K.) in toluene at a silicone resin solid matter concentration of 20 wt. % was added thereto. The mixture was then stirred for 2 hours at the same temperature and heat-treated at 150° C. for 2 hours in an inert gas atmosphere of nitrogen gas to obtain Magnetic carrier particles Xi, wherein the coating with the silicone resin was sufficient and uniform as a result of a observation through an electron microscope.

Magnetic carrier particles XI exhibited properties shown in Table 2 and image-forming performances shown in Table 3.

Example 9

1 kg of Magnetic carrier particles II were stirred at 70° C. in a universal stirrer ("5XDML"), and a solution of 15 g as solid of a silicone resin ("SR2422", mfd. by Toray Dow Corning K.K.) and 0.7 g of a coupling agent ("KBM-903", mfd. by Shin-Etsu Kagaku Kogyo K.K.) in toluene at a silicone resin solid matter concentration of 20 wt. % was added thereto. The mixture was then stirred for 2 hours at the same temperature and heat-treated at 200° C. for 2 hours in an inert gas atmosphere of nitrogen gas to obtain Magnetic carrier particles XII, wherein the coating with the silicone resin was sufficient and uniform as a result of a observation through an electron microscope.

Magnetic carrier particles XII exhibited properties shown in Table 2 and image-forming performances shown in Table 3.

Examples 10–14 and Comparative Examples 4–6

Magnetic carrier particles XIII–XX were prepared in the same manner as in Example 8 except for changing magnetic carrier particles as starting materials and species and amount of coating resins as shown in Table 2. The properties and image-forming performances of the resultant magnetic carrier particles are also shown in Tables 2 and 3, respectively.

Magnetic carrier particles XVI prepared in Comparative Example 4 by directly coating Carrier core particles A with a styrene-acrylate copolymer resin resulted in a remarkable change in triboelectric charge due to the vibration durability test. This is presumably because of a weak adhesion of the coating resin onto the carrier core particles.

Magnetic carrier particles XVII and XVIII prepared in Comparative Examples 5 and 6 respectively exhibited a somewhat larger change in $Q_{TC}$ before and after the durability vibration test. This may be attributable to the use of magnetic carrier particles IX (Comparative Example 5) and X (Comparative Example 6), i.e., to a weak adhesion of the coating layer to the carrier core particles due to the use of identical species (epoxy group in Comparative Example 5 and amino group in Comparative Example 6) for the functional group (A) of the lipophilizing agent in the carrier core particles and the functional group (B) of the coupling agent below the coating resin layer, thus resulting in peeling of the coating layer due to a mechanical impact in the vibration durability test leading to a change in triboelectric charge.

In Table 2, the symbols for the coating resins represent the following resins.

KR221: straight silicone resin ("KR221", mfd. by Shin-Etsu Kagakuy Kogyo K.K.)

SR2411: straight silicone resin ("SR2411", mfd. by Toray Dow Corning K.K.)

BR-52: styrene-methyl methacrylate copolymer resin (mfd. by Mitsubishi Rayon K.K.)

KF polymer: polyvinylidene fluoride resin (mfd. by Kureha Kagaku K.K.)

KR-251: straight silicone resin (mfd. by Shin-Etsu Kagaku K.K.)

ES1001N: epoxy-modified silicone resin (mfd. by Shin-Etsu Kagaku K.K.)

TABLE 2

| | | Coating with a further resin | | | | | | | | | | | | | | |
|---|---|---|---|---|---|---|---|---|---|---|---|---|---|---|---|---|
| | | | | | | Resin-coated carrier | | | | | | | | | | |
| | | | | | | | | | | | | | Charging performance | | | |
| | | Coating resin | | Additive | | | $d_B$ | | Coat | | $\sigma_{1000}$ | $\sigma_r$ | $Q_{TC1}$ | $Q_{TC2}$ | | |
| Ex. or Comp. Ex. | Base carrier | Name | Qty. (g) | Name | Qty. (g) | Dav. (μm) | (g/ml) | $\rho_{aq}$ | (wt. %) | Rv (ohm.cm) | ($Am^2$/kg) | ($Am^2$/kg) | (μC/g) | (μC/g) | $\Delta Q_{TC}$ (%) | Name |
| Ex. | | | | | | | | | | | | | | | | |
| 8 | I | KR221 | 10 | KMB903 | 0.3 | 35 | 1.88 | 3.53 | 0.8 | $6 \times 10^{12}$ | 29 | 3.0 | −65 | −62 | 5 | XI |
| 9 | II | SR2411 | 15 | KBM602 | 0.7 | 35 | 1.90 | 3.53 | 1.3 | $8 \times 10^{12}$ | 29 | 3.0 | −63 | −60 | 5 | XII |
| 10 | III | BR-52 | 10 | — | — | 25 | 1.76 | 3.52 | 0.9 | $7 \times 10^{14}$ | 57 | 5.1 | −48 | −45 | 6 | XIII |
| 11 | IV | KF polymer | 12 | — | — | 51 | 1.92 | 3.56 | 1.1 | $4 \times 10^{13}$ | 51 | 4.8 | −26 | −24 | 8 | XIV |
| 12 | VI | KR-251 | 25 | KBM903 | 0.3 | 60 | 1.92 | 3.54 | 2.3 | $7 \times 10^{12}$ | 56 | 7.1 | −52 | −50 | 4 | XV |
| 13 | VII | ES1001N | 10 | — | — | 35 | 1.88 | 3.53 | 0.8 | $8 \times 10^{12}$ | 29 | 3.0 | −57 | −55 | 4 | XVI |

TABLE 2-continued

| Ex. or Comp. Ex. | Base carrier | Coating resin Name | Coating resin Qty. (g) | Additive Name | Additive Qty. (g) | Coating with a further resin: Dav. (μm) | $d_B$ (g/ml) | $\rho_{aq}$ | Coat (wt. %) | Rv (ohm.cm) | Resin-coated carrier: $\sigma_{1000}$ ($Am^2$/kg) | $\sigma_r$ ($Am^2$/kg) | Charging performance: $Q_{TC1}$ (μC/g) | $Q_{TC2}$ (μC/g) | $\Delta Q_{TC}$ (%) | Name |
|---|---|---|---|---|---|---|---|---|---|---|---|---|---|---|---|---|
| Comp. Ex. | | | | | | | | | | | | | | | | |
| 4 | VIII | BR-52 | 20 | KBM573* | 0.5 | 38 | 1.71 | 3.56 | 1.5 | $7 \times 10^{10}$ | 28 | 3.1 | −45 | −18 | 60 | XVII |
| 5 | IX | BR-52 | 15 | KBM602 | 0.3 | 35 | 1.83 | 3.55 | 1.3 | $3 \times 10^{12}$ | 29 | 3.0 | −40 | −25 | 38 | XVIII |
| 6 | X | KR221 | 10 | — | — | 35 | 1.82 | 3.54 | 1.3 | $4 \times 10^{8}$ | 57 | 7.0 | −43 | −21 | 51 | XIX |

*KBM573: a silane coupling agent having an amino group.

TABLE 3

| Ex. & Comp. Ex. | Magnetic carrier | Image density Initial | Image density $10^4$ sheets | Solid image uniformity Initial | Solid image uniformity $10^4$ sheets | Fog Initial | Fog $10^4$ sheets |
|---|---|---|---|---|---|---|---|
| Ex. 1 | I | 1.55 | 1.50 | A | B | A | B |
| Ex. 2 | II | 1.52 | 1.48 | A | B | A | B |
| Ex. 3 | III | 1.62 | 1.56 | A | B | B | B |
| Ex. 4 | IV | 1.65 | 1.55 | B | B | B | C |
| Ex. 5 | V | 1.55 | 1.52 | A | B | A | B |
| Ex. 6 | VI | 1.58 | 1.48 | B | B | B | B |
| Ex. 7 | VII | 1.48 | 1.58 | B | C | C | C |
| Comp. Ex. 1 | VIII | 1.52 | 1.35 | C | D | C | D |
| Comp. Ex. 2 | IX | 1.58 | 1.72 | C | C | C | C |
| Comp. Ex. 3 | X | 1.52 | 1.74 | C | C | C | C |
| Ex. 8 | XI | 1.60 | 1.62 | A | A | A | A |
| Ex. 9 | XII | 1.60 | 1.59 | A | A | A | A |
| Ex. 10 | XIII | 1.62 | 1.68 | A | B | B | C |
| Ex. 11 | XIV | 1.52 | 1.46 | A | B | A | A |
| Ex. 12 | XV | 1.50 | 1.53 | A | B | A | B |
| Ex. 13 | XVI | 1.50 | 1.41 | A | B | B | C |
| Comp. Ex. 4 | XVII | 1.50 | 1.31 | B | C | C | D |
| Comp. Ex. 5 | XVIII | 1.50 | 1.64 | B | C | C | C |
| Comp. Ex. 6 | XXIX | 1.51 | 1.32 | B | C | B | C |

<Surface-coating with a resin of magnetic carrier core particles>

Example 14

In a universal stirrer ("5XDML", mfd. by K. K. Dalton), 1 kg of Carrier core particles A were placed and stirred until the internal temperature reached 50° C. Then, 20 g as solid of styrene-diethylaminoethyl acrylate copolymer having an amino group dissolved in toluene was added and the internal temperature was maintained at 50° C. The stirring was further continued for 2 hours at the temperature to provide a magnetic carrier comprising Carrier core particles A coated with the styrene-diethylaminoethyl acrylate copolymer (hereinafter called "Magnetic carrier particles 1").

As a result of observation through an electron microscope, the coating with the styrene-diethylaminoethyl acrylate copolymer was sufficient and uniform at a coating rate of 1.7 wt. %. As is shown in Table 4, magnetic carrier particles 1 exhibited Dav=35 μm, $d_B$=1.90 g/ml, $_{sq}$=3.53, $R_V$=5×$10^{15}$ ohm.cm, $\sigma_{1000}$=29 $Am^2$/kg, $\sigma_r$=3.1 $Am^2$/kg, a triboelectricity change=2% ($Q_{TC}$=−72 μC/g and −70 μC/g, before and after vibration, respectively). Magnetic carrier particles 1 also exhibited image-forming performances as shown in Table 5.

Example 15

In a universal stirrer ("5XDML", mfd. by K. K. Dalton), 1 kg of Carrier core particles B were placed and stirred until the internal temperature reached 50° C. Then, 20 g as solid of acrylate-modified silicone resin having an ester group dissolved in toluene was added and the internal temperature was heated to 70° C. The stirring was further continued for 2 hours at the temperature, and a heat-treatment at 200° C. was performed in an inert gas atmosphere to cure the coating of the acrylate-modified silicone resin, thereby providing magnetic carrier particles 2, which exhibited properties shown in Table 4 and image-forming performances shown in Table 5.

Examples 16–20 and Comparative Examples 7–10

Magnetic carrier particles 3–11 were prepared in the same manner as in Example 15 except for changing the carrier core particles and changing the species including the presence or absence of functional group and coating amount of coating resins. Magnetic carrier particles 3–7 prepared in Examples 10–20 all exhibited sufficient and uniform coating of the coating resin.

Properties and image-forming performances of Magnetic carrier particles 3–11 are shown in Tables 4 and 5, respectively.

Magnetic carrier particles 8 of Comparative Example 7 were obtained by coating Carrier core particles A with a straight silicone resin having no functional group.

Magnetic carrier particles 9–11 of Comparative Examples 8–10 were obtained by coating the carrier core particles with coating resins having functional groups (C) identical to functional groups (A) of lipophilizing agents for treating the inorganic compound particles contained in the relevant carrier core particles, i.e., epoxy group (Comparative Examples 8 and 9) and amino groups (Comparative Example 10). As a result, these magnetic carrier particles resulted in somewhat larger changes in triboelectric charge due to the vibration durability test than Magnetic carrier particles 1 of Example 1.

Symbols for the coating resins in Table 4 have the following meanings respectively.

S-DEAEA: styrene-diethylaminoethyl acrylate copolymer (mol ratio=70:30, Mw=12000)

TSR 171: acrylate-modified silicone resin (mfd. by Toray Silicone K.K.)

S683-1M: melamin-formalin resin (mfd. by Dai-Nippon Ink Kagaku K.K.)

ESN1001N: epoxy-modified silicone resin (mfd. by Shiin-Etsu Kagaku K.K.)

ER4003: polyester resin (mfd. by Mitsubishi Rayon K.K.)

BR-52: styrene-methyl methacrylate copolymer resin (mfd. by Mitsubishi Rayon K.K.)

KR-251: straight silicone resin (mfd. by Shin-Etsu Kagaku K.K.)

TABLE 4

Coating with a resin having a functional group

| Ex. or Comp. Ex. | Carrier core Name | Qty. (g) | F.G.* | Coating resin | Qty. (g) | Additive Name | Qty. (g) | Dav. (μm) | $d_B$ (g/ml) | $\rho_{sq}$ |
|---|---|---|---|---|---|---|---|---|---|---|
| Ex. | | | | | | | | | | |
| 14 | A | 1000 | amino | S-DEAFA | 20 | — | — | 35 | 1.90 | 3.53 |
| 15 | B | 1000 | ester | TSR171 | 20 | — | — | 24 | 1.80 | 3.53 |
| 16 | C | 1000 | amino | S683-1M | 12 | — | — | 44 | 1.92 | 3.56 |
| 17 | D | 1000 | epoxy | ES1001N | 15 | KBM403 | 0.5 | 51 | 1.98 | 3.57 |
| 18 | A | 1000 | amino | S683-1M | 10 | — | — | 36 | 1.91 | 3.54 |
| 19 | D | 1000 | ester | ER1003 | 15 | — | — | 51 | 1.97 | 3.56 |
| 20 | D | 1000 | ester | BR-52 | 25 | — | — | 52 | 1.96 | 3.55 |
| Comp. Ex. | | | | | | | | | | |
| 7 | A | 1000 | — | KR-251 | 20 | — | — | 35 | 1.90 | 3.55 |
| 8 | C | 1000 | epoxy | ES1001N | 10 | — | — | 44 | 1.92 | 3.55 |
| 9 | A | 1000 | epoxy | ES1001N | 10 | KBM602 | 0.3 | 51 | 1.92 | 3.55 |
| 10 | E | 1000 | amino | S683-1M | 10 | — | — | 35 | 1.83 | 3.51 |

| Ex. or Comp. Ex. | Coat. (wt. %) | Rv (ohm.cm) | $\sigma_{1000}$ ($Am^2/kg$) | $\sigma_r$ ($Am^2/kg$) | Charging performance $Q_{TC1}$ (μC/g) | $Q_{TC2}$ (μC/g) | $\Delta Q_{TC}$ (%) | Name |
|---|---|---|---|---|---|---|---|---|
| Ex. | | | | | | | | |
| 14 | 1.7 | $5 \times 10^{15}$ | 29 | 3.1 | −72 | −70 | 3 | 1 |
| 15 | 1.8 | $7 \times 10^{12}$ | 58 | 5.0 | −48 | −45 | 6 | 2 |
| 16 | 1.1 | $4 \times 10^{12}$ | 47 | 4.5 | −72 | −70 | 3 | 3 |
| 17 | 1.3 | $5 \times 10^{12}$ | 52 | 4.8 | −45 | −43 | 4 | 4 |
| 18 | 0.8 | $5 \times 10^{14}$ | 29 | 3.0 | −42 | −40 | 5 | 5 |
| 19 | 1.3 | $7 \times 10^{14}$ | 51 | 4.7 | −41 | −40 | 2 | 6 |
| 20 | 2.3 | $6 \times 10^{15}$ | 51 | 4.7 | −62 | −60 | 3 | 7 |
| Comp. Ex. | | | | | | | | |
| 7 | 1.7 | $7 \times 10^{12}$ | 29 | 3.1 | −35 | −10 | 71 | 8 |
| 8 | 0.8 | $3 \times 10^{10}$ | 47 | 4.5 | −28 | −20 | 29 | 9 |
| 9 | 0.7 | $3 \times 10^{10}$ | 29 | 3.0 | −52 | −40 | 23 | 10 |
| 10 | 0.5 | $3 \times 10^{9}$ | 57 | 7.0 | −39 | −22 | 44 | 11 |

*F.G. = Functional group.

TABLE 5

| Ex. & Comp. Ex. | Magnetic carrier | Image density Initial | Image density $10^4$ sheets | Solid image uniformity Initial | Solid image uniformity $10^4$ sheets | Fog Initial | Fog $10^4$ sheets |
|---|---|---|---|---|---|---|---|
| Ex. 15 | 1 | 1.55 | 1.50 | A | B | A | B |
| Ex. 16 | 2 | 1.52 | 1.48 | A | B | A | B |
| Ex. 17 | 3 | 1.63 | 1.56 | A | B | B | B |
| Ex. 18 | 4 | 1.65 | 1.55 | B | B | B | C |
| Ex. 19 | 5 | 1.55 | 1.52 | A | B | A | B |
| Ex. 20 | 6 | 1.58 | 1.48 | B | B | B | B |
| Ex. 21 | 7 | 1.51 | 1.48 | B | B | B | B |
| Comp. Ex. 7 | 8 | 1.52 | 1.35 | C | D | C | D |
| Comp. Ex. 8 | 9 | 1.58 | 1.43 | B | C | B | C |
| Comp. Ex. 9 | 10 | 1.39 | 1.35 | C | C | C | C |
| Comp. Ex. 10 | 11 | 1.47 | 1.73 | B | C | C | C |

What is claimed is:

1. A magnetic carrier, comprising:

composite particles each comprising at least inorganic compound particles and a binder resin, wherein said inorganic compound particles have been surface-treated with a lipophilizing agent having an epoxy group, and said composite particles are surface-coated with a coupling agent having a functional group (B) selected from the group consisting of amino group and mercapto group.

2. A magnetic carrier, comprising:

composite particles each comprising at least inorganic compound particles and a binder resin, wherein said inorganic compound particles have been surface-treated with a lipophilizing agent having a functional group (A) selected from the group consisting of epoxy group, ester group, mercapto group, organic acid group, ketone group, halogenated alkyl group and aldehyde group, and said composite particles are surface-coated with a silane coupling agent having an amino group.

3. The magnetic carrier according to claim 2, wherein the amino group is a primary amino group.

4. A magnetic carrier, comprising:

composite particles each comprising at least inorganic compound particles and a binder resin, wherein said inorganic compound particles have been surface-treated with a lipophilizing agent having a functional group (A) selected from the group consisting of epoxy group, amino group, mercapto group, organic acid group, ester group, ketone group, halogenated alkyl group and aldehyde group, said composite particles are surface-coated with a coupling agent having a functional group (B) different from the functional group (A) of the lipophilizing agent and selected from the group consisting of epoxy group, amino group and mercapto group, and the functional group (B) of the coupling agent surface-coating the composite particles is reactive with the functional group (A) of the lipophilizing agent surface-treating the inorganic compound particles in the composite particles.

5. The magnetic carrier according to claim 4, wherein the functional group (B) is epoxy group, and the functional group (A) is a group selected from the group consisting of amino group, mercapto group and organic acid group.

6. The magnetic carrier according to claim 4, wherein the functional group (B) is amino group, and the functional group (A) is a group selected from the group consisting of epoxy group, mercapto group, organic acid group, ester group, ketone group, halogenated alkyl group and aldehyde group.

7. The magnetic carrier according to claim 4, wherein the functional group (B) is mercapto group, and the functional group (A) is a group selected from the group consisting of amino group, epoxy group, organic acid group, ester group, ketone group and aldehyde group.

8. The magnetic carrier according to claim 4, wherein the composite particles are surface-coated with the coupling agent in a proportion of 0.001–5.0 wt. % of the composite particles.

9. The magnetic carrier according to claim 4, wherein the binder resin comprises a thermosetting resin.

10. The magnetic carrier according to claim 9, wherein the binder resin comprises penolic resin.

11. The magnetic carrier according to claim 4, wherein the composite particles surface-coated with the coupling agent is further coated with a further coating resin.

12. The magnetic carrier according to claim 11, wherein the further coating resin is present in a proportion of at least 0.05 wt. % of the composite particles.

13. The magnetic carrier according to claim 11, wherein the further coating resin comprises silicone resin.

14. The magnetic carrier according to claim 11, wherein the silicone resin is in mixture with a coupling agent.

15. The magnetic carrier according to claim 14, wherein the coupling agent in mixture with the silicone resin is a silane coupling agent.

16. The magnetic carrier according to claim 14, wherein the coupling agent in mixture with the silicone resin is a silane coupling agent having an amino group.

17. The magnetic carrier according to claim 4, wherein the composite particles have a weight-average particle size of 10–50 $\mu$m.

18. The magnetic carrier according to claim 4, wherein the composite particles have a weight-average particle size of 15–45 $\mu$m.

19. The magnetic carrier according to claim 4, wherein the inorganic compound particles comprise magnetic iron compound particles.

20. The magnetic carrier according to claim 4, wherein the inorganic compound particles comprise magnetic iron oxide particles.

21. The magnetic carrier according to claim 20, wherein the magnetic iron oxide particles contain a member selected from the group consisting of silicon oxide, silicon hydroxide, aluminum oxide and aluminum hydroxide.

22. The magnetic carrier according to claim 21, wherein the magnetic iron oxide particles contain aluminum oxide.

23. The magnetic carrier according to claim 4, wherein the inorganic compound particles comprise a mixture of magnetic iron compound particles and nonmagnetic inorganic compound particles.

24. The magnetic carrier according to claim 23, wherein the nonmagnetic inorganic compound particles comprise nonmagnetic iron oxide particles.

25. The magnetic carrier according to claim 24, wherein the magnetic iron oxide particles have an average particle size a, and the nonmagnetic iron oxide particles have an average particle size b satisfying $a<b$.

26. The magnetic carrier according to claim 25, wherein the average particle size a of the magnetic iron oxide particles and the average particle size b of the nonmagnetic iron oxide particles, satisfy the following relationship:

$$0.2\ \mu m \leqq a \leqq 2\ \mu m,$$

$$0.05\ \mu m \leqq b \leqq 5\ \mu m,$$

and $$1.5a < b.$$

27. A magnetic carrier comprising:

composite particles each comprising at least inorganic compound particles and a binder resin, wherein said inorganic compound particles have been surface-treated with a lipophilizing agent having a functional group (A) selected from the group consisting of epoxy group, ester group, amino group, mercapto group, organic acid group, ketone group, halogenated alkyl group and aldehyde group, said composite particles are surface-coated with a coupling agent having a functional group (B) different from the functional group (A) of the lipophilizing agent and selected from the group consisting of epoxy group, amino group and mercapto group, and the composite particles have a specific gravity of 2.5–4.5, a magnetization ($\sigma_{1000}$) as measured in a magnetic field of 1000 oersted of 15–60 $Am^2/kg$, a residual magnetization ($\sigma r$) of 0.1–20 $Am^2/kg$, and a resistivity of $5\times10^{11}$–$5\times10^{15}$ ohm.cm.

28. A magnetic carrier, comprising:

composite particles each comprising at least inorganic compound particles and a binder resin, wherein said inorganic compound particles have been surface-treated with a lipophilizing agent having a functional group (A)

said composite particles are surface-coated with a coating resin having a functional group (C) different from the functional group (A) of the lipophilizing agent and said functional groups (A) and (C) are determined according to a combination selected from the group consisting of the following combinations (I)–(VI):

(I) the functional group (C) is epoxy group, and the functional group (A) is a group selected from the group consisting of amino group, mercapto group and organic acid group;

(II) the functional group (C) is amino group, and the functional group (A) is a group selected from the group consisting of epoxy group, mercapto group, organic acid group, ester group, ketone group, halogenated alkyl group and aldehyde group;

(III) the functional group (C) is organic acid group, and the functional group (A) is a group selected from the group consisting of amino group, epoxy group, mercapto group, ester group, ketone group, halogenated alkyl group and aldehyde group;

(IV) the functional group (C) is ester group, and the functional group (A) is a group selected from the group consisting of amino group, mercapto group, organic acid group, ketone group, halogenated alkyl group and aldehyde group;

(V) the functional group (C) is ketone group, and the functional group (A) is a group selected from the group consisting of amino group, mercapto group, organic acid group, ester group, halogenated alkyl group and aldehyde group; and (VI) the functional group (C) is halogenated alkyl group, and the functional group (A) is a group selected from the group consisting of amino group, epoxy group, organic acid group, mercapto group, ester group, ketone group and aldehyde group, wherein the functional group (C) of the coating resin surface-coating the composite particles is reactive with the functional group (A) of the lipophilizing agent surface-treating the inorganic compound particles in the composite particles.

29. The magnetic carrier according to claim 28, wherein the lipophilizing agent is a coupling agent selected from the group consisting of silane coupling agent, titanate coupling agent, and aluminum coupling agent each having the functional group (A).

30. The magnetic carrier according to claim 28, wherein the lipophilizing agent is a silane coupling agent having the functional group (A).

31. The magnetic carrier according to claim 28, wherein the inorganic compound particles have been treated with the lipophilizing agent in a proportion of 0.1–5.0 wt. % of the inorganic compound particles.

32. The magnetic carrier according to claim 28, wherein the composite particles are surface-coated with the coating resin in a proportion of at least 0.05 wt. % of the composite particles.

33. The magnetic carrier according to claim 28, wherein the binder resin comprises a thermosetting resin.

34. The magnetic carrier according to claim 33, wherein the binder resin comprises phenolic resin.

35. The magnetic carrier according to claim 28, wherein the composite particles have a weight-average particle size of 10–50 $\mu m$.

36. The magnetic carrier according to claim 28, wherein the composite particles have a weight-average particle size of 15–45 $\mu m$.

37. The magnetic carrier according to claim 28, wherein the inorganic compound particles comprise magnetic iron compound particles.

38. The magnetic carrier according to claim 28, wherein the inorganic compound particles comprise magnetic iron oxide particles.

39. A magnetic carrier comprising:

composite particles each comprising at least inorganic compound particles and a binder resin, wherein said inorganic compound particles have been surface-treated with a lipophilizing agent having a functional group (A) selected from the group consisting of epoxy group, amino group, mercapto group, organic acid group, ester group, ketone group, halogenated alkyl group and aldehyde group, said composite particles are surface-coated with a coating resin having a functional group (C) different from the functional group (A) of the lipophilizing agent and selected from the group consisting of epoxy group, amino group, organic acid group, ester group, ketone group and halogenated alkyl group, and said composite particles have a specific gravity of 2.5–4.5, a magnetization ($\delta_{1000}$) as measured in a magnetic field of 1000 oersted of 15–60 $Am^2/kg$, a residual magnetization ($\delta_r$) of 0.1–20 $Am^2/kg$, and a resistivity of $5\times10^{11}$–$5\times10^{15}$ ohm.cm.

40. A magnetic carrier comprising:

composite particles each comprising at least inorganic compound particles and a binder resin, wherein said inorganic compound particles have been surface-treated with a lipophilizing agent having an epoxy group, said composite particles are surface-coated with a coupling agent having a functional group (B) selected from the group consisting of amino group and mercapto group, wherein the inorganic compound particles comprise magnetic iron oxide particles, and the magnetic iron oxide particles contain a member selected from the group consisting of silicon oxide, silicon hydroxide, aluminum oxide and aluminum hydroxide.

41. The magnetic carrier according to claim 40, wherein the magnetic iron oxide particles contain aluminum oxide.

42. A magnetic carrier comprising:

composite particles each comprising at least inorganic compound particles and a binder resin, wherein said inorganic compound particles have been surface-treated with a lipophilizing agent having an epoxy group, and said composite particles are surface-coated with a coupling agent having a function group (B) selected from the group consisting of amino group and mercapto group, wherein the inorganic compound particles comprise a mixture of magnetic iron oxide particles and nonmagnetic inorganic oxide particles, and an average particle size a of the magnetic iron oxide particles and a average particle size b of the nonmagnetic iron oxide particles satisfy the following relationship:

$$0.2\ \mu m \leqq a \leqq 2\ \mu m$$

$$0.05\ \mu m \leqq b \leqq 5\ \mu m,$$

and $$1.5\ a < b.$$

* * * * *

UNITED STATES PATENT AND TRADEMARK OFFICE

CERTIFICATE OF CORRECTION

PATENT NO. : 6,506,531 B1
DATED : January 14, 2003
INVENTOR(S) : Toshiyuki Hakata et al.

It is certified that error appears in the above-identified patent and that said Letters Patent is hereby corrected as shown below:

Column 1,
Line 29, “articles,” should read -- particles, --.

Column 4,
Line 32, “due” should read -- do --.

Column 5,
Line 28, “γ-glycidoxypropylmethyldemethoxysilane,” should read
-- γ-glycidoxypropylmethyldimethoxysilane, --.

Column 7,
Line 62, “it” should read -- they --.

Column 10,
Line 61, “member results” should read -- member, results --.

Column 11,
Line 44, “comprise” should read -- that comprise --.

Column 13,
Line 16, “a” should be deleted; and
Line 52, “condition” should read -- conditioner --.

Column 14,
Line 24, “were” should read -- was --; and
Line 61, “A: Dr–Ds≦ 0.4[{]p1B: 0.5%<Dr–Ds≦0.8%” should read
-- A: Dr–Ds≦ 0.4%
B: 0.05%<Dr–Ds≦0.8% --.

Column 16,
Line 67, “polydegral” should read -- polyhedral --.

Column 19,
Line 5, “particles—were” should read -- particles I were --.

Column 20,
Line 31, “Kagakuy” should read -- Kagaku --.

UNITED STATES PATENT AND TRADEMARK OFFICE

CERTIFICATE OF CORRECTION

PATENT NO. : 6,506,531 B1 
DATED : January 14, 2003
INVENTOR(S) : Toshiyuki Hakata et al.

It is certified that error appears in the above-identified patent and that said Letters Patent is hereby corrected as shown below:

Column 22,
Line 22, "$_{sq}$=3.53," should read -- $\rho_{sq}$=3.53, --.

Column 26,
Line 20, "penolic" should read -- phenolic --; and
Line 23, "is" should read -- are --.

Column 27,
Line 27, "$_{(\sigma 1000)}$" should read -- ($\sigma_{1000}$) --; and
Line 29, "(σr)" should read -- ($\sigma_r$) --.

Column 28,
Line 60, "($\delta_{1000}$)" should read -- ($\sigma_{1000}$) --; and
Line 62, "($\delta_r$)" should read -- ($\sigma_r$) --.

Column 30,
Line 2, "function" should read -- functional --.

Signed and Sealed this

Twenty-ninth Day of June, 2004

JON W. DUDAS
*Acting Director of the United States Patent and Trademark Office*